US009012750B2

(12) United States Patent
Berndt

(10) Patent No.: US 9,012,750 B2
(45) Date of Patent: Apr. 21, 2015

(54) CROWN TOP BAR FRET, STRINGED INSTRUMENT INCLUDING SAME, AND METHOD OF MANUFACTURE

(71) Applicant: Lawrence Berndt, Cornish, NH (US)

(72) Inventor: Lawrence Berndt, Cornish, NH (US)

( * ) Notice: Subject to any disclaimer, the term of this patent is extended or adjusted under 35 U.S.C. 154(b) by 0 days.

(21) Appl. No.: 14/153,474

(22) Filed: Jan. 13, 2014

(65) Prior Publication Data

US 2014/0202305 A1 Jul. 24, 2014

Related U.S. Application Data

(60) Provisional application No. 61/755,619, filed on Jan. 23, 2013, provisional application No. 61/894,965, filed on Oct. 24, 2013.

(51) Int. Cl.
*G10D 3/00* (2006.01)
*G10D 3/06* (2006.01)

(52) U.S. Cl.
CPC ..... *G10D 3/06* (2013.01)

(58) Field of Classification Search
USPC ..... 84/267, 290, 293
See application file for complete search history.

(56) References Cited

U.S. PATENT DOCUMENTS

| | | | |
|---|---|---|---|
| 501,743 | A | 7/1893 | Stratton |
| 1,727,620 | A | 9/1929 | Smith |
| 4,064,779 | A | 12/1977 | Petillo |
| 4,633,754 | A | 1/1987 | Chapman |
| 4,748,887 | A | 6/1988 | Marshall |
| 4,846,038 | A | 7/1989 | Turner |
| 6,100,458 | A | 8/2000 | Carrington et al. |
| 6,103,961 | A | 8/2000 | Kaufman |
| 6,114,618 | A | 9/2000 | Anke |
| 6,369,306 | B2 | 4/2002 | Chapman |
| 6,538,183 | B2 | 3/2003 | Verd |
| 6,613,969 | B1 | 9/2003 | Petillo et al. |
| 7,692,080 | B1 | 4/2010 | Rushing |

(Continued)

FOREIGN PATENT DOCUMENTS

FR 002686181 A1 * 7/1993 ..... 84/293

OTHER PUBLICATIONS

Photograph #1, taken May 22, 2014, of rectangular bar frets in a Martin guitar produced in 1875, 1 page.

(Continued)

*Primary Examiner* — Kimberly Lockett
(74) *Attorney, Agent, or Firm* — Nields, Lemack & Frame, LLC

(57) ABSTRACT

Stringed instrument having an elongated neck member optionally including a fingerboard, with a plurality of frets fixedly positioned at predetermined spaced locations along the neck. The frets include a tang and a mushroom shaped crown, each positioned and secured in a corresponding fret slot formed in the neck. The neck member includes a carbon fiber based support member that can be T-shaped. In its method aspects, the neck can be straight and of neutral strain or a desired backbow/underbow or curvature in the elongated neck member is created, such as by introducing a carbon fiber T-bar support member in the neck member in a "neutral" state while clamping the neck member in an underbow shape, or forming underbow directly into the finished neck in which a carbon fiber T-bar is already present, and then introducing crown bar style frets to wedge the neck back to an optimum playable shape.

15 Claims, 5 Drawing Sheets

(56) References Cited

U.S. PATENT DOCUMENTS

| | | | | |
|---|---|---|---|---|
| 8,183,447 | B1 | 5/2012 | Chapman | |
| 8,653,345 | B1 * | 2/2014 | Rogers | 84/314 N |
| 2006/0070507 | A1 | 4/2006 | Nevanen et al. | |
| 2008/0148919 | A1 | 6/2008 | LaMarra | |
| 2009/0272248 | A1 | 11/2009 | Papenfus | |

OTHER PUBLICATIONS

Photograph #2, taken May 22, 2014, of rectangular bar frets in a Martin guitar produced in 1875, 1 page.

Dan Erlewine's Guitar Repair Services, The Plek Machine, http://www.danerlewine.com/plek.html, Dec. 20, 2012, pp. 1-12.

* cited by examiner

CROWN TOP BAR FRET, STRINGED INSTRUMENT INCLUDING SAME, AND METHOD OF MANUFACTURE

This application claims priority of U.S. Provisional Application Ser. No. 61/755,619 filed Jan. 23, 2013 and U.S. Provisional Application Ser. No. 61/894,965 filed Oct. 24, 2013, the disclosures of which are incorporated herein by reference.

BACKGROUND

Frets for stringed musical instruments, particularly guitars, banjos and the like, provide a mechanism for stopping vibrations of the strings at spaced locations on the playing surface (fingerboard or fretboard) of the neck of the instrument over which the strings extend in tension to produce the desired musical tones when the strings are actuated, such as by plucking, strumming or picking. Frets are positioned transversely along the longitudinal dimension of the neck (and generally perpendicularly to the strings) beneath the strings at predetermined spaced locations, and thus string length can be effectively adjusted by pressing the strings into contact with a particular fret. This presets the length of the vibrating portion of the string, thereby controlling the frequency of the tone produced. The fingerboard may be integral with the neck and made of the same material as the neck, or it may be made of a different material and coupled to the neck such as by lamination. It may be flat or slightly radiused.

Conventional frets are made of metal and are generally T-shaped. The stem or tang of the fret is embedded into or otherwise secured to the instrument neck, and the crown or head of the fret extends above the surface of the neck and provides the working surface against which the string or strings are finger-pressed to create the desired tone. The tang may have one or more barbs to help anchor or secure the fret in the fingerboard.

The first guitar frets were "bar" frets made from flat stock. These frets project square out of the neck and had no mushroom crown. They measured about 0.50"×0.200"×X" long. Some manufacturers actually had 4 or 5 gauges of bar fret stock ranging from about 0.045" to 0.058". The limited quality control at that time meant that there were also thickness deviations within each gauge.

These bar frets were hammered into the sawn fret slots in the fingerboard to a depth of about 0.100" and became integral to the neck. The various gauges were employed to control the shape of the neck from the side view. They were used to counter the string tension that would otherwise cause the neck to bow. Given the tapered shape of the neck, and the different string gauges from bass to treble, neck bow would be irregular.

The bar frets were used to hold the line of the neck when under string tension. When the luthier was satisfied with the bar fret choice and placement, the tops of the bars were filed down to somewhat uniform height to ease playability. The bar frets transferred the string vibration directly to the neck. In this way, the frets became part of the structure of the neck. It is a simple structure as one side/back is in tension and the other side/front is in compression. As such, the neck resonated in response to playing. The integral bar frets transferred the string vibration directly into the neck and contributed to the overall tonal quality of the instrument. It is almost universally agreed on by players and listeners that such early guitars, with bar frets, have incomparable tonal qualities.

Necks with such bar frets do not require a truss rod (though an embedded stiffener of stronger wood or metal, including a truss rod, can be used).

The use of bar frets was discontinued in the mid 1930's—except for use in restoration and a few guitars built by certain luthiers. Their correct use was an art. They were difficult to use, install, and get "right". There was no significant reinforcement in those necks so the fit of the frets had to be precise. These old style bar frets were square on top, and had to be left high enough to accommodate for hills and valleys in the actual neck line. After installation they were typically filed by hand into adequate playability.

Modern frets have a typical tang that is 0.020" thick and is perforated to make little barbs that secure the fret in the neck like weather stripping. Since the tang is so thin and flimsy, the modern fret wire does not play a role in supporting the neck by becoming integral to the neck. Necks using such fret wire require a truss rod to counter string tension and hold the neck straight. Steel T-Bars and square steel tube were used before the single action adjustable truss rod appeared.

Currently, a single or double action truss rod to control the neck and modern frets glued in oversized slots are used. Modern frets have no structural role in the neck. They are simply held in an oversize slot by their barbed (springy) tang and glue. Wire fret/truss rod necks do not seem as tonally alive as bar fret necks.

In order for each string to have room to vibrate, clearance provided by the nut/bridge height relationship or a slight curvature must be formed in the neck. If the strings sit too high above the neck surface, the instrument is difficult to play. If the strings sit too low above the neck surface, they buzz against the frets.

Recently, the Plek® machine was developed to set up stringed instruments using computer numerical control (CNC) to level and shape fretboards and frets in an efficient manner. The instrument is scanned to measure the position of each string on the fretboard, typically at the first and twelfth frets. The measured results are compared to a suggested optimum, and the truss rod in the neck is adjusted to obtain the desired relief for the neck. The strings are then removed, and the frets are cut based upon the measurements made. The relief of the neck created by the string tension is taken into account while calculating the process parameters.

It would be desirable to obtain the stability and tonal performance advantages of bar frets while eliminating the concomitant set up difficulties of the prior art. It also would be desirable to provide neck technology that maximizes stability, playability, and tonal response in stringed instruments, particularly guitars.

SUMMARY

The shortcomings of the prior art have been overcome by the embodiments disclosed herein, which include a stringed instrument having an elongated neck member having a longitudinal dimension, the elongated neck member optionally including a fingerboard, with a plurality of frets fixedly positioned transversely relative to the longitudinal dimension, at predetermined spaced locations along the elongated neck member. In accordance with certain embodiments, the frets include a tang and a mushroom shaped crown. The bottom of the tang can be square, rounded, or beveled. Each is positioned and secured in a corresponding fret slot formed in the elongated neck member. In accordance with certain embodiments, the stringed instrument includes a main body from which the elongated neck member extends, and the string or strings are operatively coupled under tension to the main body at or near one end of the string or strings, and are operatively coupled under tension to the elongated neck member at or near another end of the string or strings. In accordance with certain embodiments, the elongated neck member includes a carbon fiber based support member that can be T-shaped. The result is an instrument with neck technology that maximizes stability, playability and tonal response, and avoids note distortion and playability issues of the prior art.

In its method aspects, embodiments disclosed herein include building a guitar neck, incorporating a reinforcing member such as a carbon fiber Tbar in the neck, with a final strength less than the string tension of the strings used on the instrument. In this manner, some of the work of resisting string tension falls to the crown top bar frets. These act as wedges or fulcrums at each fret location, controlling the shape of the neck and transferring string vibration to the neck. The bar frets are installed in a manner that compliments the above parameters to optimize the desired shape of the neck. When this is done so that there is also an embodied strain present in the neck, tonal response will increase.

In accordance with certain embodiments, a desired underbow (e.g., 0.010"-0.030") or curvature is pre-loaded in the elongated neck member, such as by installing a reinforcing member such as a carbon fiber T-bar support member in the neck member in a "neutral" state while clamping the neck member in an underbow shape, thus pre-setting underbow, or forming, such as by milling, underbow directly into the finished neck in which a carbon fiber T-bar is already present, and then introducing crown bar style frets into the neck member to wedge the neck back to an optimum playable shape. In this manner, the work of keeping the neck straight by resisting the string tension falls to the crown shaped bar frets. These act as wedges or fulcrums at each fret location, controlling the shape of the neck and transferring string vibration to the neck.

Yet another embodiment is to induce a slight (0.010"-0.030"; e.g. 0.020") backbow in a straight or underbowed neck using the bar frets as wedges. Strings of sufficient gauge are then attached under tension sufficient to pull this neck to a playable shape.

The result is an organization and control of forces in the neck member, which ensures stability and allows for very fine "set up" tolerances by the luthier, producing a more precise and resonant product.

DETAILED DESCRIPTION

Figure 1:
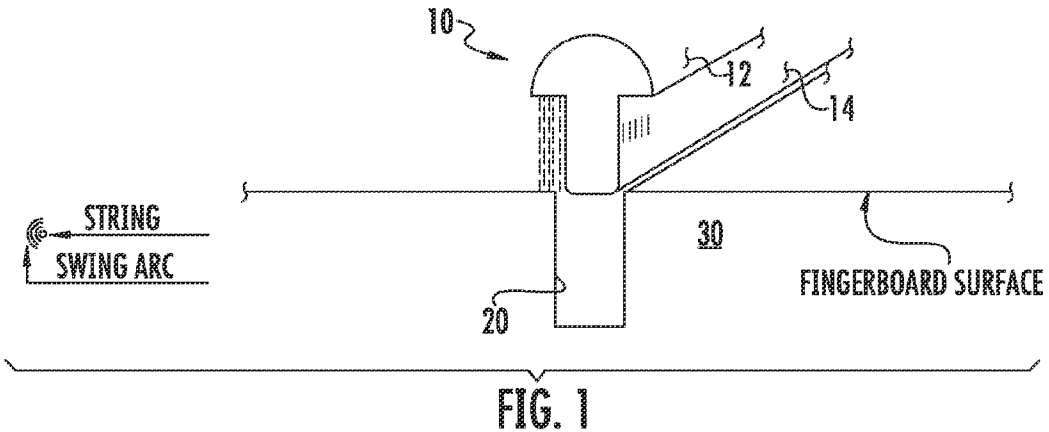
FIG. 1 is a perspective view of a crown bar fret in accordance with certain embodiments.

In accordance with certain embodiments, the combination of wood, a carbon fiber reinforcing member, crown shaped bar fret gauge and placement of crown shaped bar frets, and string choice, produce a neck structure for a musical instrument such as a guitar having a body and a peghead. In accordance with certain embodiments, this neck structure is produced in such a way that it embodies fret resisted underbow strain to enhance tonal response, while maintaining the setup and action preferred by the player, when part of a musical instrument such as a guitar. The objective is to build a neck with embodied strain that enhances tonal response, while maintaining the setup and action preferred by the player. This is achieved by creating resistant strain in a straight, or slightly backbowed/underbowed neck that is increased by string tension and countered by the wedge effect of the solid tangs of the crown top bar frets. No truss rod is required.

Suitable wood types for necks include maples and mahoganies, although those skilled in the art will appreciate that other woods types may be suitable. Necks can be made from a single piece or several pieces of wood adhered together. Some necks have added fingerboards instead of the fingerboard being an integral part of the neck wood. The strength and compressive resistance of the specific piece determines the effect of a specific fret gauge in that neck.

The carbon fiber reinforcing member can be in a T-shape, and can have varying levels of flexibility or modulus. This allows flexibility when considering the best neck structure for a given instrument—from an electric bass to an orchestral model guitar for fingerpicking. For example, in certain embodiments, a "standard" reinforcing member may have a modulus of 19. An "intermediate" reinforcing member may have a modulus of 23. A "high" reinforcing member may have an even higher modulus of 28. Those skilled in the art will appreciate that these moduluses are illustrative only; reinforcing members with different amounts of flexibility can be used.

In certain embodiments, wood strips can be attached to the reinforcing member, such as with a suitable epoxy, to modify the tone and expand the tonal range, for example. Suitable woods include mahogany, pine and cedar, as well as blends thereof. Each wood blends a unique "tap tone" that alters the final tone of the instrument. Examples of a carbon fiber reinforcing T-bar epoxied to wood strips are shown in FIGS. 7A, 7B, 7C and 8A, 8B and 8C.

In certain embodiments, gun drilling can be used to facilitate pressing a dowel (with an included or embedded reinforcing member) into the interior of a neck. Gun drilling is a process that produces deep, straight holes in the material being drilled. A very round hole with a precision diameter can be produced with a gun drill. The use of gun drilling and broaching creates an internal cavity for accepting the reinforcing member or wood augmented reinforcing member into the interior of the neck.

In certain embodiments, the gun drilled hole can then be further shaped, such as by broaching, to create a suitable cavity to accommodate the wood augmented reinforcing member.

The crown top bar frets used in accordance with the embodiments disclosed herein are a rounded mushroom type crown with a narrower rectangular tang. Preferably the crown is uniformly sized in a given model. Preferably each instrument uses crown top bar frets having different tang gauges.

By choosing the appropriate tang gauge, the frets function as positive or negative wedges to control backbow and underbow shape and strain. For example, one instrument may include bar frets with a crown 0.080" wide×0.045" high; with tang thickness gauges from 0.046" to 0.058" (e.g., 0.046", 0.048", 0.050", 0.052", 0.054", 0.056" and 0.058") in 0.002" increments along the longitudinal length of the neck member. The tang length can range from about 0.075"-0.100". For example, one suitable tang length may be 0.095". For replacement in heavily worn used necks, the tang length may need to be shortened to less than the above range, such as 0.060". The frets are used as positive/negative wedges to control neck alignment, cause embodied strain in the neck member, and counter string tension.

In certain embodiments, the frets are force-fit into respective fret slots, such as by hammering. The thickness of the rigid tang is manipulated to create a positive/negative wedge effect in the fret slots. This is used, in conjunction with reinforcing member such as a carbon fiber Tbar, and string tension, to control the final "lay" and action of the neck. This style of neck does not require the support or adjustability of a conventional truss rod inside the neck. The tangs of the frets are preferably barbless and of uniform cross-section.

In some embodiments, the fret slots may be cut 0.050" wide×0.100" deep. This allows a thinner tang to introduce relief into the neck.

A set of bass strings can create 200 pounds of string tension in a four string electric base. A set of six nylon strings may create as little as 40 pounds of string tension in a small classical guitar. By knowing ahead of time the string tension (and string gauge) that will be used, the appropriate amount of strain can be placed in the neck member by several different methods, as discussed below.

Neck strength, shape, and embodied strain can be created in several ways. It can be increased/decreased by the choice of reinforcing member and how it is installed. For example, the reinforcing member may be installed in a neutral manner, with the neck flat. The bar frets may be used to induce a slight backbow. An underbow can then be milled into the neck (e.g., 0.010-0.020"), and the crown top bar frets can then be used as needed to counter the underbow. Alternatively, the neck may be maintained, such as by clamping, in an underbowed state and a straight slot or cavity may be milled in the neck for the reinforcing member. The reinforcing member is then secured in the neck, such as by gluing, while the neck remains clamped in the underbow state. Realigning is then carried out using crown top bar frets of suitable gauges. Alternatively still, a straight or backbowed neck may be produced with the reinforcing member, and heavy gauge strings may be used to "overpower" the reinforcing member to produce the desired playable shape. Realigning is then carried out using crown top bar frets of suitable gauges in conjunction with the string tension. Another alternative is to mill a bow, (backbow or underbow), in the neck and force the fingerboard to that bow when adhered to the neck.

Turning now to FIG. 1, there is shown a crown top bar fret 10 in a position about to be inserted into a fret slot 20 in a neck member 30 of a musical instrument, in accordance with certain embodiments. The fret 10 includes an elongated top or head portion 12, that is semi-spherical in cross-section or "crown shaped", and an elongated tang 14 that extends downwardly from the bottom of the head portion 12, which is generally rectangular in cross-section. In certain embodiments, the tang may be continuous along the length of the fret 10, may be solid, and may be devoid of barb members and any other protrusions or discontinuities. Suitable tang widths can vary between about 0.046" and about 0.058", and a height that can vary between about 0.070" and about 0.100".

Figure 2:
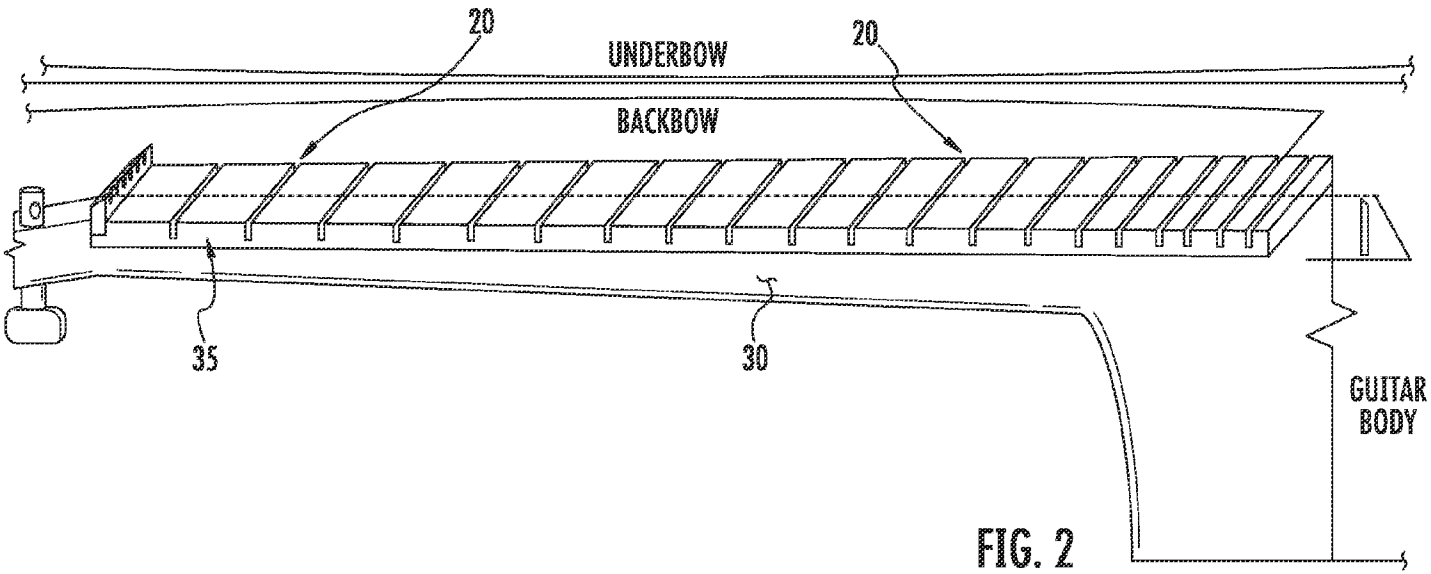
FIG. 2 is a perspective view of a guitar neck in accordance with certain embodiments.

FIG. 2 illustrates a fretboard or fingerboard surface 35, having a plurality of spaced fret slots 20 each for receiving a particular fret 10 transversely along its length at spaced locations. In the embodiment shown, suitable fret slot 20 dimensions are 0.050" wide by 0.100" deep. By choosing from various tang gauge options, the frets can be used as positive or negative wedges to control backbow and underbow of the neck member 30. A similar effect could be achieved by using frets having the same gauge in each fret slot, and adjusting each fret slot to produce the desired neckline shape.

Figure 3:
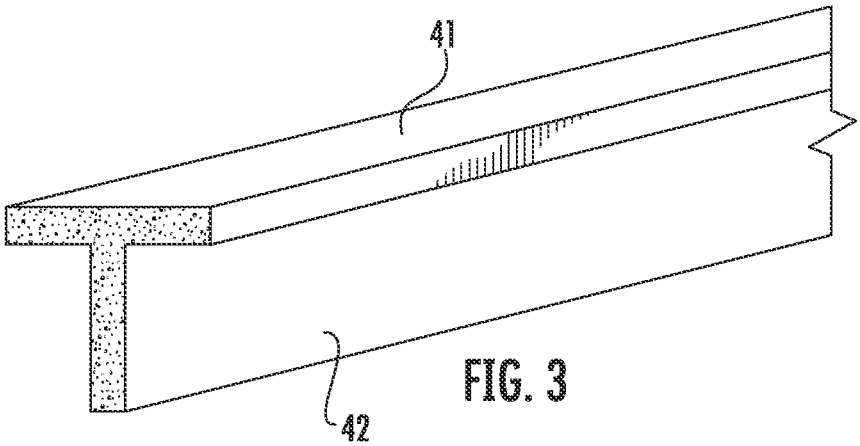
FIG. 3 is a perspective view of a neck reinforcing member in accordance with certain embodiments.
Figure 4:
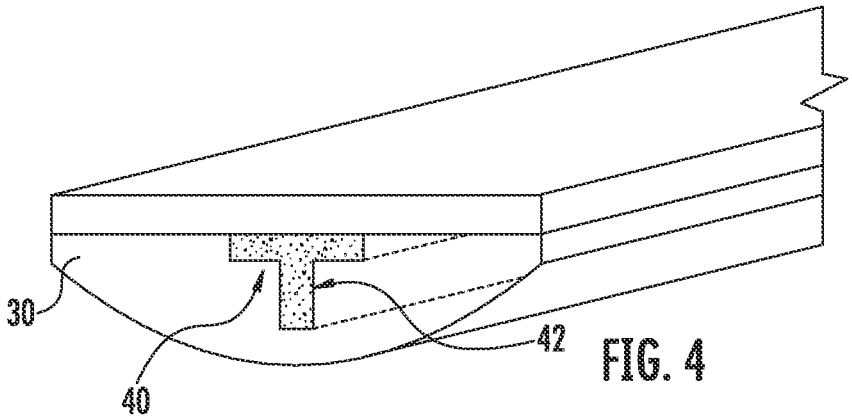
FIG. 4 is a perspective view of a neck member having a reinforcing member embedded therein, in accordance with certain embodiments.

FIGS. 3 and 4 illustrate an embodiment of the carbon fiber reinforcing member 40. In certain embodiments, the elongated member 40 is non-adjustable (e.g., it has a fixed length), unitary, and is T-shaped in cross-section, with the head 41 of the T being about 0.5" in width, and the leg 42 of the T extending downwardly from the head. In certain embodiments, the leg 42 is centrally located with respect to the width of the head 41. In certain embodiments, the overall height of the member 40 is about 0.5". In certain embodiments, the thickness of both the head 41 and leg 42 is about 0.100". In certain embodiments, the reinforcing member 40 comprises about 60% carbon, and is made by a pultrusion process. Its rigidity can vary based on the modulus of the carbon used, e.g., 19.3 ("standard"), 23.7 ("intermediate") and 28.1 ("high"). The more rigid the reinforcing member 40, the less effect the frets and strings will have in countering the curvature of the neck. As seen in FIG. 4, the reinforcing member 40 is inserted into an appropriately spaced T-shaped groove or cavity formed in the body of the neck 30, preferably so that the reinforcing member extends completely or substantially completely along the length of the neck member 30. The reinforcing member 40 is adhered in place in the neck member 30, such as with an adhesive such as an epoxy. In certain embodiments, the reinforcing member 40 is fully enclosed in the neck member 30.

Figure 5A:
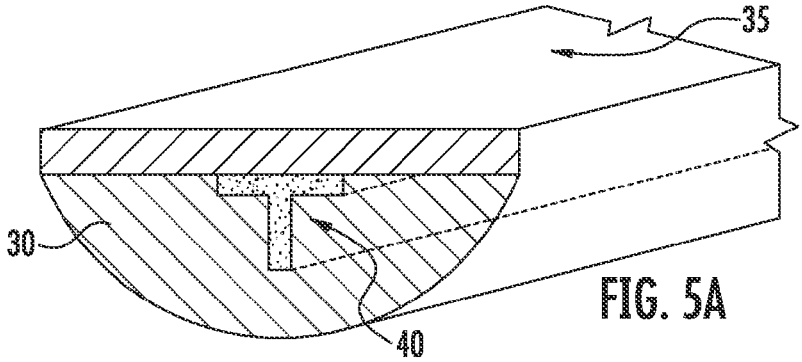
FIG. 5A is a perspective view of a neck member having a fingerboard applied, and including a reinforcing member in accordance with certain embodiments.
Figure 5B:
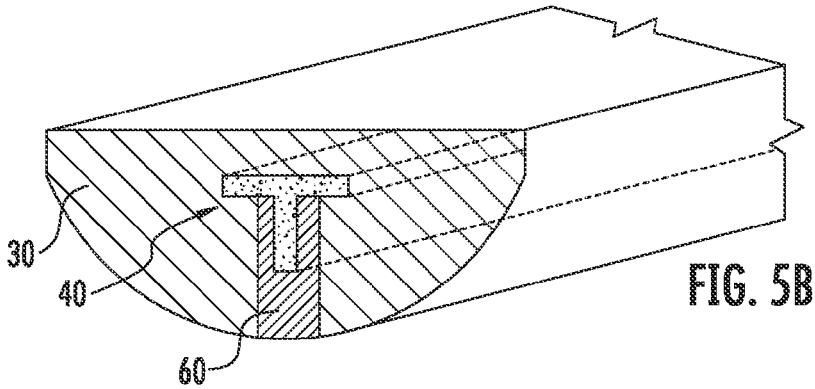
FIG. 5B is a perspective view of a neck member having an integral fingerboard and including a reinforcing member and a skunk stripe in accordance with certain embodiments.
Figure 6:
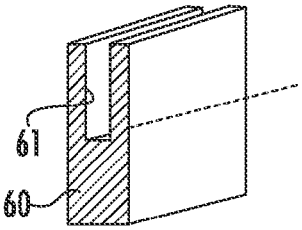
FIG. 6 is a perspective view of a skunk stripe in accordance with certain embodiments.
Figure 7A:
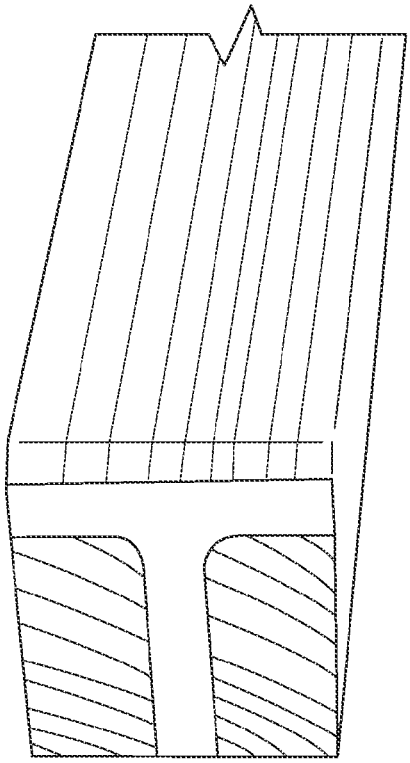
FIGS. 7A, 7B and 7C are perspective views of a wood strips epoxied to reinforcing members in accordance with certain embodiments.
Figure 7B:
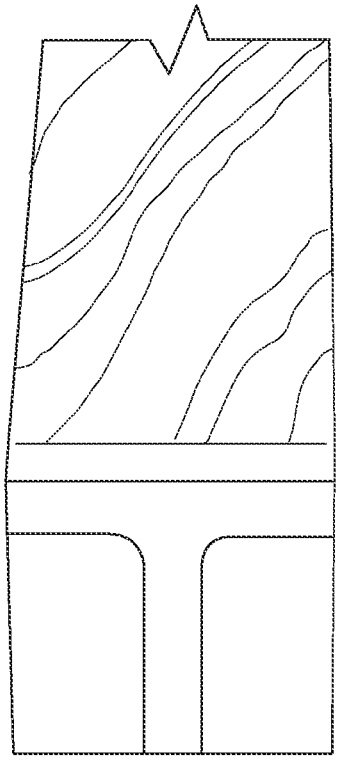
Figure 7C:
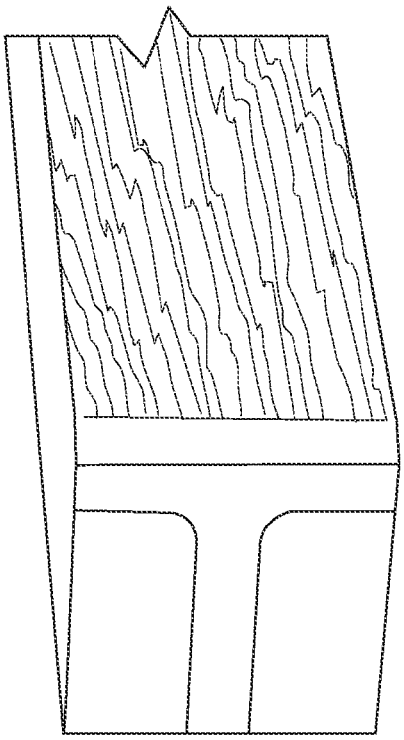
Figure 8A:
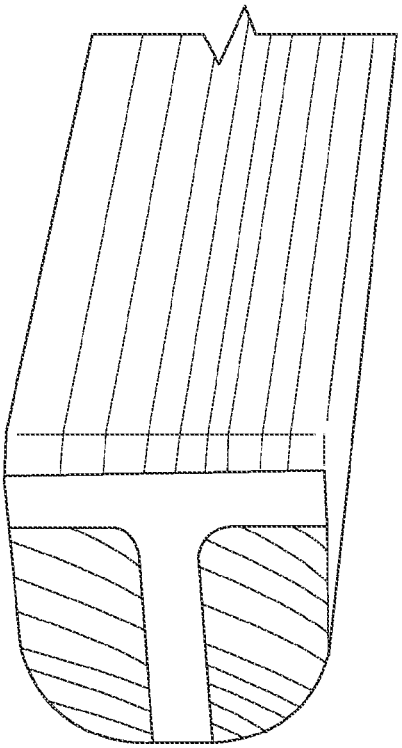
FIGS. 8A, 8B and 8C are perspective views of a wood strips epoxied to reinforcing members in accordance with certain embodiments.
Figure 8B:
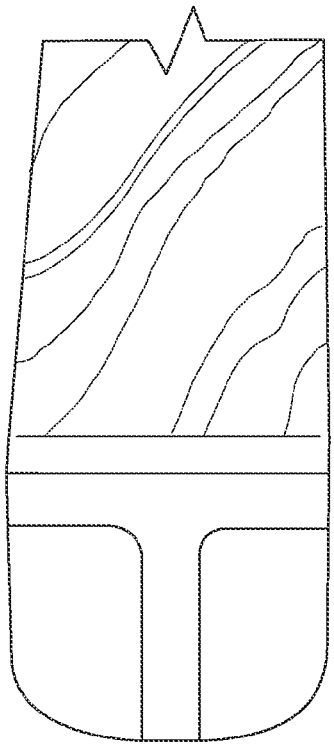
Figure 8C:
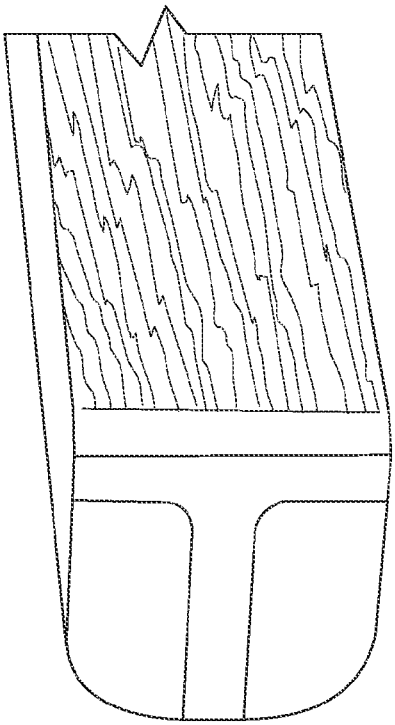

Excess space between the reinforcing member 40 and the neck member 30 can be filled with additional adhesive and/or spacers, and/or with a "skunk stripe" 60 as shown in FIGS. 5B and 6. The skunk stripe 60 is an elongated wood strip having a slot 61, which can be centrally located with respect to the strip width, formed along its length that is dimensioned to receive the leg 42 of the reinforcing member 40.

In the embodiment shown in FIG. 5A, the neck 30 includes an applied fingerboard 35. The neck 30 is shown with the inclusion of the reinforcing member 40. In the embodiment shown in FIG. 5B, the neck has an integral fingerboard. The surface of the fingerboard can be milled in the neck and an underbow milled in it as well.

Figure 5C:
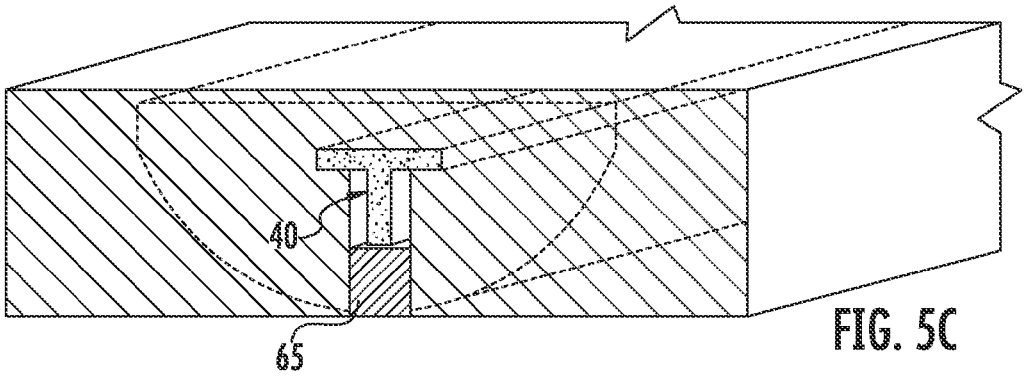
FIG. 5C is a perspective view of a neck member blank prior milling and including a reinforcing member in accordance with certain embodiments.

FIG. 5C illustrates an embodiment where the reinforcing member 40 is introduced into a cavity in a neck blank prior to forming (such as by milling) the neck into its final shape. The regions between the leg 42 of the reinforcing member 40 and the neck blank body can be filed with spacers 65 and/or adhesive, such as an epoxy.

To manufacture a guitar, the parameters for the guitar are determined. Manufacturers have designated models for electric, acoustic, classical, bluegrass, rock, jazz etc. Each model has design elements unique to it such as types of wood, thickness of top, style of top bracing, neck shape, number of frets to the body, type of fingerboard, nut width, suitable string gauge, binding, and finish. These parameters are well known to those skilled in the art.

In general, the style of the guitar is determined, and the appropriate neck wood is chosen. The reinforcing member is selected, with the rigidity or modulus thereof chosen depending upon parameters that may include the guitar style, neck wood chosen and the string gauge to be used. For example, a carbon fiber Tbar with a standard modulus (as defined above) can be used for classical finger-style guitars that will have a mahogany neck and will use nylon strings with a light gauge; a carbon fiber Tbar with an intermediate modulus (as defined above) can be used for folk, pop, rock, blues and strumming guitars that will have mahogany necks and light gauge steel strings; and a carbon fiber Tbar with a high modulus (as defined above) can be used for electric and jazz guitars having maple necks, as well as for hard working aggressively played acoustic guitars including bluegrass, jazz and blues guitars.

The reinforcing member is installed in the neck as discussed above, and the neck can be flexed for the luthier to obtain a sense of its stiffness. The neck is then finished to the point where fret slots would normally be cut. At this point the neck is straight longitudinally and will have a normal radius across its width. Fret slots are cut, such as 0.050" wide× 0.100" deep. The 0.050" width is recommended because it optimizes flexibility, since it is near the middle of the fret gauge selections.

Optionally, the instrument can be strung and tuned at this point to gain an understanding of the tension that the crown shaped bar frets will need to counter.

Un-reinforced necks do not bow evenly under string tension. Conventional bar fret guitars had no significant reinforcement, thereby requiring close attention to fret fit. This meant that the wrong gauge fret in a single location would have a significant impact on the neck shape. In addition, the conventional bar frets had to be high enough to make up for the hills and valleys in the neck line because very few luthiers were good enough or had the time luxury to fit a perfect neck. The contributed rigidity of the reinforcing member smoothes out the effect of string tension (lengthening the transition areas mentioned) and also smoothes out the impact of an individual, poorly fitted fret—this simplifies the fret work by not requiring tedious fitting of old style tbars; and still yields a very smooth neck line that minimizes fret filing/dressing so the action can be set most favorably for the player.

Two important transition areas are the $3^{rd}$ to $5^{th}$ fret and the $12^{th}$ to $14^{th}$ fret. This neck has significant reinforcement that smoothes out the transition areas but not completely. These same locations will continue to be important. The remaining fret locations will generally not be pivotal locations except in remedial neck work.

The straightness of the neck is checked with a true straight edge, and 0.050" gauge crown shaped bar frets are inserted into slots #1 and #2, respectively, such as by hammering. They should enter the slots smoothly with little force other than the force required to conform the fret to the neck radius. The neck curvature is checked again with the straight edge and now should be substantially straight. A 0.052" gauge crown shaped bar fret is inserted into slot #3, such as by hammering. This should require more force than that required for slots #1 and #2 and the neck should now show some backbow from slot #3 on down to the nut (the slotted member at the peghead end of the fingerboard where the strings pass over and through. If the 1st fret is #1, the nut is 0). 0.050" crown shaped bar frets are inserted into slots #4 through #14, such as by hammering. These frets should go in much the same as those in slots #1 & #2. 0.048" crown shaped bar frets are inserted into slots #15 through 20 that are over the guitar body, such as by hammering.

The instrument is then strung and tuned, and the neck curvature is measured again with a straight edge. If it is too underbowed near the 4th fret, the 0.050" 4th fret can be replaced with a 0.052" crown shaped bar fret, and the curvature is checked again. If undesired curvature is still present, the $5^{th}$ fret can be replaced if needed (e.g., if too much underbow is present, the 0.050" crown shaped bar fret can be replaced with a 0.052" crown shaped bar fret).

Proceed in this way until the neck has the optimum playing shape. Once the shape is as desired, the frets can be dressed (such as by filing) to obtain the exact playability desired. This neck is now fully set-up for this gauge string set on this guitar.

Those skilled in the art appreciate that once a model has been established, or a luthier has made a few of the same neck structures, a correct fret pattern emerges for that structure, and the appropriate crown shaped bar fret gauges can be inserted in the appropriate locations without having to continually evaluate curvature and remove and replace various frets to counter it.

EXAMPLE 1

A mahogany neck for a six string acoustic guitar to have medium gauge strings may be prepared as follows.

The neck is built as a flat neck with a carbon fiber reinforcing member installed in a cavity formed in the neck body and secured therein using epoxy, under the fingerboard, in a neutral position (zero strain), and a flat fingerboard is optionally adhered to the neck such as by gluing. Scale length is used to determine fret spacing, and 20 fret slots are cut, where required, that are 0.050" wide and 0.100" deep. Beginning at the tuning head end of the neck, 0.050" gauge crown top bar frets are hammered into fretslot numbers 1 & 2. A 0.052" gauge crown top bar fret is hammered into fretslot number 3. Fretslots numbers 4 through 14 receive 0.050" gauge crown top bar frets. Fretslots number 15-20 receive gauge 0.048" crown top bar frets. The guitar is then strung and tuned.

The setup is checked and adjusted as needed by interchanging appropriate gauges of frets. When satisfied with the setup, the frets are further secured in place such as by gluing. The heads of the frets are then dressed to fine tune the final setup.

What is claimed is:

1. A elongated neck member for a musical instrument, said neck member having an embodied strain, a longitudinal dimension and comprising a surface, a plurality of frets positioned transversely with respect to said longitudinal dimension at spaced locations along said neck member, and having one or more strings disposed at a height above said surface, each of said plurality of frets comprising a mushroom shaped crown and a tang extending therefrom, said mushroom shaped crown defining a working surface of said fret above said surface and against which said one or more strings can be placed in contact, each of said plurality of frets wedged into said neck member to establish said embodied strain, and a carbon fiber based reinforcing member positioned in said neck body.

2. The neck of claim 1, wherein said plurality of frets includes frets of different gauges.

3. The neck of claim 1, wherein said reinforcing member has a fixed length.

4. The neck of claim 1, wherein said reinforcing member is T-shaped.

5. The neck of claim 1, wherein said instrument is a guitar.

6. The neck of claim 1, wherein said neck member comprises a fretboard.

7. A stringed musical instrument, comprising a body, a peghead, and a neck member having embodied strain, said neck member have a longitudinal dimension, a surface, a plurality of frets positioned transversely with respect to said longitudinal dimension at spaced locations along said neck member, and having one or more strings disposed in tension at a height above said surface, each of said plurality of frets comprising a mushroom shaped crown and a tang extending therefrom, said mushroom shaped crown defining a working surface of said fret above said surface and against which said one or more strings can be placed in contact, each of said plurality of frets wedged into said neck member to establish said embodied strain, and a carbon fiber based reinforcing member positioned in said neck body.

8. The instrument of claim 7, wherein said plurality of frets includes frets of different gauges.

9. The instrument of claim 7, wherein said reinforcing member has a fixed length.

10. The instrument of claim 7, wherein said reinforcing member is T-shaped.

11. The instrument of claim 7, wherein said instrument is a guitar.

12. The instrument of claim 7, wherein said neck member comprises a fretboard.

13. A method of making a neck member for a musical instrument, comprising:

providing an elongated neck member having a cavity;

creating an underbow shape in said elongated neck; forming a cavity in said neck while maintaining said underbow shape;

introducing a carbon fiber reinforcing member into said cavity while maintaining said underbow shape;

securing said carbon fiber reinforcing member in said cavity; and forcing a plurality of crown bar frets into said neck member to wedge said neck member to establish embodied strain.

14. A method of making a neck member for a musical instrument, comprising:

providing an elongated neck member having a cavity;

introducing a carbon fiber reinforcing member into said cavity;

milling said neck member to have an underbow shape; and forcing a plurality of crown bar frets into said neck member to wedge said neck member to counter said underbow shape.

15. A method of making a neck member for a musical instrument comprising:

providing an elongated neck member having a cavity;

introducing a carbon fiber reinforcing member into said cavity;

forcing said neck member to a backbow by introducing a plurality of crown shaped bar frets into said neck member; and pulling said neck ember to a playable shape by attaching a plurality of strings to said neck member under tension.

* * * * *